United States Patent [19]

Mieno et al.

[11] Patent Number: 4,760,822

[45] Date of Patent: Aug. 2, 1988

[54] METHOD FOR CONTROLLING THE AIR/FUEL RATIO OF AN INTERNAL COMBUSTION ENGINE WITH A FUEL CUT OPERATION

[75] Inventors: Toshiyuki Mieno; Toyohei Nakajima; Yasushi Okada; Nobuyuki Oono, all of Wako, Japan

[73] Assignee: Honda Giken Kogyo Kabushiki Kaisha, Tokyo, Japan

[21] Appl. No.: 946,023

[22] Filed: Dec. 24, 1986

[30] Foreign Application Priority Data

Dec. 26, 1985 [JP] Japan ..... 60-294408

[51] Int. Cl.[4] ..... F02D 41/14

[52] U.S. Cl. ..... 123/325; 123/589

[58] Field of Search ..... 123/325, 326, 493, 489, 123/589, 440

[56] References Cited

U.S. PATENT DOCUMENTS 4,186,691 2/1980 Takase et al. ..... 123/325
4,355,618 10/1982 Müller et al. ..... 123/489
4,648,370 3/1987 Kobayashi et al. ..... 123/440
4,697,559 10/1987 Suzuki et al. ..... 123/489
4,697,567 10/1987 Sawada et al. ..... 123/489

FOREIGN PATENT DOCUMENTS 58-214626 12/1983 Japan ..... 123/493
58-222928 12/1983 Japan ..... 123/493

*Primary Examiner*—Andrew M. Dolinar
*Attorney, Agent, or Firm*—Birch, Stewart, Kolasch & Birch

[57] ABSTRACT

A method for controlling an air/fuel ratio of an internal combustion engine. The fuel supply is performed normally by a feedback control operation for controlling the air/fuel ratio of the mixture toward a target air/fuel ratio in accordance with an oxygen concentration in an exhaust gas of the engine. A fuel cut operation under a predetermined condition includes a step for detecting a transition from the fuel cut operation to resume the fuel supply, and a step for shifting, for a time period after a detection of the transition, the target air/fuel ratio of the feedback control to a lean side with respect to a target air/fuel ratio value to be used after the elapse of the time period.

10 Claims, 8 Drawing Sheets

Fig. 1 A
Fig. 1 B
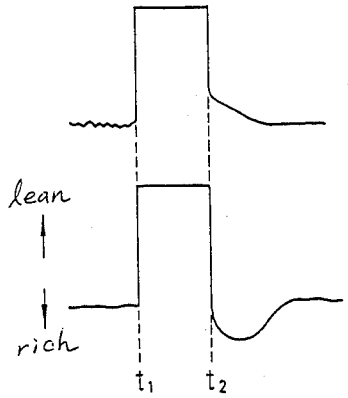
Fig. 2
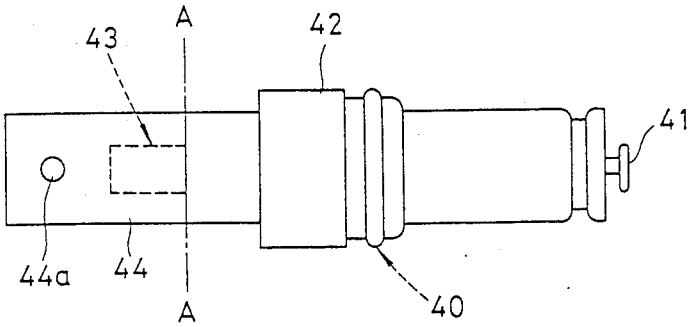

Fig. 11
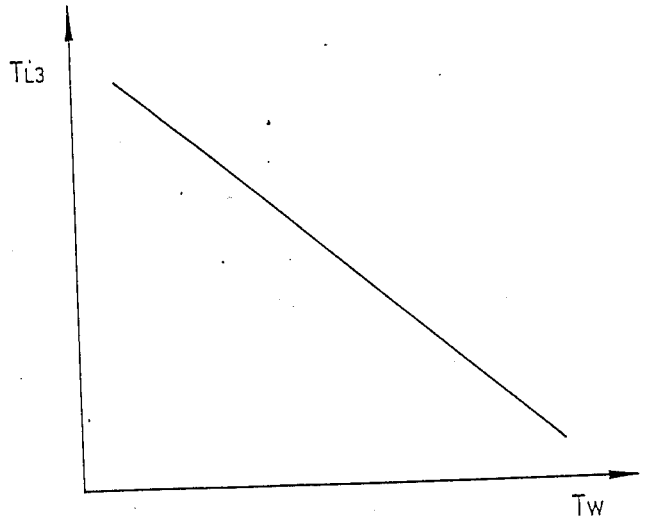
Fig. 12A
Fig. 12B
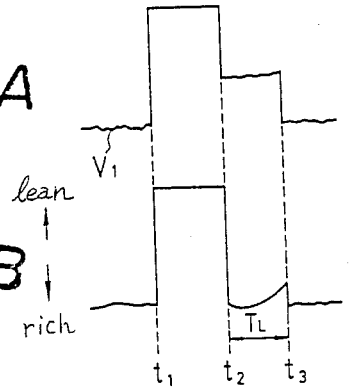

METHOD FOR CONTROLLING THE AIR/FUEL RATIO OF AN INTERNAL COMBUSTION ENGINE WITH A FUEL CUT OPERATION

BACKGROUND OF THE INVENTION

1. Field of the Invention

The present invention relates to a method for controlling the air/fuel ratio of an internal combustion engine with a fuel cut operation.

2. Description of Background Information

In order to accelerate the purification of the exhaust gas and to improve the fuel economy of an internal combustion engine, a feedback type air/fuel ratio control system is generally used. Oxygen concentration in the exhaust gas is detected and an air/fuel ratio of the mixture supplied to the engine is controlled to a target air/fuel ratio by a feedback control operation in accordance with a result of the detection of the oxygen concentration.

As an oxygen concentration sensor for use in such an air/fuel ratio control system, there is a type which generates an output signal whose level is proportional to the oxygen concentration in a gas whose oxygen concentration is to be measured. The detail of which is disclosed in Japanese Patent Application laid open No. 58-153155. With this type of oxygen concentration sensor generating an output signal proportional to the oxygen concentration, it is possible to control the air/fuel ratio very accurately.

On the other hand, if the engine rotation is maintained with the throttle valve closed, for example, when the engine is decelerating, the vacuum in the intake manifold will rise quickly due to the closure of the throttle valve. High vacuum may in turn lead to an increase of harmful components (especially, carbon monoxide CO) in the exhaust gas because the air/fuel ratio is very much enriched under such a condition. In order to prevent the increase of noxious components, a fuel cut operation may be used in some cases. In the case of a carburetor type fuel metering system, the fuel cut operation is performed by a low-speed circuit of the carburetor that stops the fuel supply to the engine. On the other hand, if the fuel metering system is of the type using a fuel injector, then the drive of the fuel injector is stopped for the fuel cut operation. In the case of the feedback type air/fuel ratio control system, the operation of the system is such that the feedback operation is stopped during the fuel cut operation, and the system resumes the feedback control operation upon completion of the fuel cut operation. During the fuel cut operation, the fuel that adheres to the inner walls of the intake manifold is sucked into the cylinders of the engine as a result of the increase of the vacuum in the intake manifold caused by the closure of the throttle valve. Also, the temperature in the combustion chamber drops during the fuel cut operation. Because of these reasons, the output signal level of the oxygen concentration sensor represents the concentration of an unburnt oxygen component immediately after a completion of the fuel cut operation. For example, as shown in FIG. 1A, the output signal level of the oxygen concentration sensor gradually decreases after a time $t_2$ of the completion of the fuel cut operation. Therefore, if the feedback air/fuel ratio control which is based on the output signal of the oxygen concentration sensor is started immediately after the completion of the fuel cut operation, the air/fuel ratio of the mixture will be controlled to the then rich side as shown in FIG. 1B. This is because the air/fuel ratio of the mixture is detected under this condition to be leaner than a target air/fuel ratio in accordance with the output signal of the oxygen concentration sensor. The supply of such a rich mixture will result in the generation of unburnt components especially carbon monoxide CO and hydrocarbons HC.

OBJECT AND SUMMARY OF THE INVENTION

An object of the present invention is, therefore, to provide a method for controlling an air/fuel ratio by which the operation for purifying the exhaust gas immediately after the completion of the fuel cut operation is greatly improved.

According to the present invention, there is provided a method for controlling an air/fuel ratio of an internal combustion engine having an air/fuel ratio control system for controlling a mixture to be supplied to the engine, comprising:

normally operating the air/fuel ratio control system by controlling an air/fuel ratio of the mixture by a feedback control operation toward a target air/fuel ratio in accordance with an oxygen concentration in an exhaust gas of the engine; placing the air/fuel ratio control system in a fuel cut mode when a condition for the fuel cut operation is satisfied; and resuming said air/fuel ratio control by performing said feedback operation while controlling the target air/fuel ratio, for a predetermined time period said fuel cut operation is terminated and said fuel supply is resumed, to be larger than a target air/fuel ratio value to be used after an elapse of the predetermined time period.

In short, during a predetermined time period after a detection of a transition from the fuel cut condition to resume the fuel supply, the target air/fuel ratio is set to be greater than the value to be used after the elapse of the predetermined time period.

According to another aspect of the invention, a method for controlling an air/fuel ratio of an internal combustion engine having an air/fuel ratio control system for controlling a mixture to be supplied to the engine, comprises:

normally operating the air/fuel ratio control system to control an air/fuel ratio of the mixture by a feedback control operation toward a target air/fuel ratio in accordance with an oxygen concentration in an exhaust gas of the engine, and placing the air/fuel ratio control system in a state for a fuel cut operation when a condition for the fuel cut operation is satisfied;

detecting at least one parameter of engine operation when the air/fuel ratio control system is in the fuel cut mode;

calculating a delay time period based on the parameter of engine operation; and resuming operation of said air/fuel control system by performing said feedback control operation while controlling the target air/fuel ratio, for the delay time period after said fuel cut operation is terminated and fuel supply is resumed, to be larger than a target air/fuel ratio value to be used after an elapse of the predetermined time period.

In short, a delay time period is determined in response to engine operation parameters detected under the fuel cut condition. During the determined delay time period after the detection of the transition from the fuel cut condition to resume the fuel supply, the target air/fuel ratio is set to be greater than the value to be used after the elapse of the delay time period.

BRIEF DESCRIPTION OF THE DRAWINGS

FIGS. 1A and 1B are diagrams respectively showing variation of an output signal level of an oxygen concentration sensor and an air/fuel ratio of the mixture at the time of a fuel cut operation;

FIG. 2 is a side view of an oxygen concentration sensor which is suitable for application of the method according to the present invention;

FIGS. 9 through 11 are diagrams showing the manner of setting of delay times $T_{L1}$, $T_{L2}$, and $T_{L3}$ respectively; and FIGS. 12A and 12B are diagrams respectively showing the variation of the output signal level of the oxygen concentration sensor and the air/fuel ratio of the mixture at the time of the fuel cut operation in accordance with the control method of the present invention.

DETAILED DESCRIPTION OF THE PREFERRED EMBODIMENTS

Figure 3:
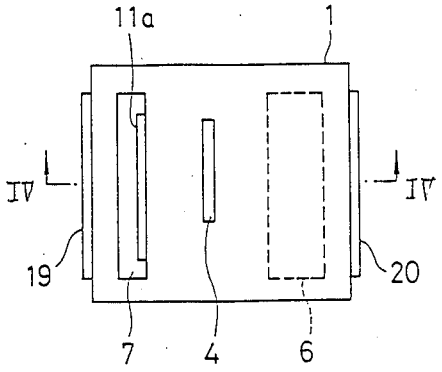
FIG. 3 is a plan view of the oxygen concentration sensing unit provided in the sensor shown in FIG. 2.

An embodiment of the method for controlling an air/fuel ratio of the present invention will be explained with reference to FIGS. 2 through 12B hereinafter.

FIG. 2 shows an oxygen concentration sensor of an air/fuel ratio control system in which the method according to the present invention is adopted. As shown, the oxygen concentration sensor generally denoted at 40 includes a housing 42 having a lead wire introducing hole 41 at an extremity thereof. At the other extremity of the housing 42, an oxygen concentration sensing unit 43 is mounted. The oxygen concentration sensing unit 43 is surrounded by a protection cover 44 which is formed into a cylinder and connected to the housing at an end portion thereof. The protection cover 44 is provided with a plurality of exhaust gas introduction holes **44*a* which are equally spaced on circumference. Four exhaust gas introduction holes 44*a* are provided in this example. In addition, a pair of oxygen concentration sensors 40 illustrated on the left side of the line A—A of FIG. 2 are introduced into an exhaust manifold (not shown) when the sensor 40** is mounted for operation.

Figure 4:
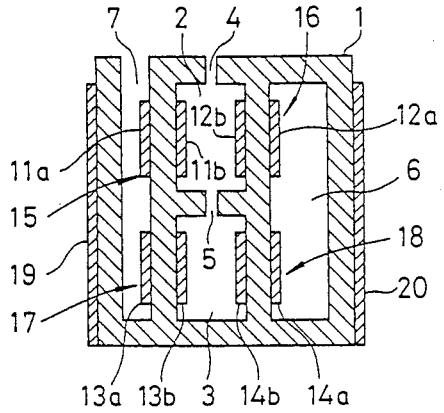
FIG. 4 is a sectional view of the oxygen concentration sensing unit taken along the line IV—IV of FIG. 3.

As shown in FIGS. 3 and 4, the oxygen concentration sensing unit 43 includes an oxygen ion conductive solid electrolyte member 1 having a generally cubic configuration. In the oxygen ion conductive solid electrolyte member 1, first and second gas retaining chambers 2 and 3, which constitute gap portions, are provided. The first gas retaining chamber 2 leads to a gas introduction port 4 for introducing the measuring gas, i.e. the exhaust gas of the engine, from outside of the oxygen ion conductive solid electrolyte member 1. The gas introduction port 4 is positioned in an exhaust gas passage (not shown) of the internal combustion engine so that the exhaust gas can easily flow into the gas retaining chamber 2. In a wall between the first gas retaining chamber 2 and the second gas retaining chamber 3, there is provided a communication chamber 5 so that the exhaust gas is introduced into the second gas retaining chamber 3 through the gas introduction port 4, the first gas retaining chamber 2 and the communication channel 5. Further, the oxygen-ion conductive solid electrolyte member 1 is provided with a reference gas chamber 6 into which outside air, for example, is introduced. The reference gas chamber 6 is provided in such a manner that it is separated from the first and second gas retaining chambers 2 and 3 by means of a partition wall between them. In a side wall of the first and second gas retaining chambers 2 and 3, on the opposite side of the reference gas chamber 6, an electrode protection cavity 7 is provided. The wall between the first gas retaining chamber 2 and the reference gas chamber 6 and the electrode protection cavity 7, are respectively provided a pair of electrodes **12*a* and 12*b*, and a pair of electrodes 11*a* and 11*b*. The electrodes 11*a*, 11*b*, and 12*a*, 12*b* form a first set of electrodes associated with the first gas retaining chamber 2. Similarly, the wall between the second gas retaining chamber 3 and the gas reference chamber 6, and the wall between the second gas retaining chamber 3 and the electrode protection cavity 7 are respectively provided with a pair of electrodes 14*a* and 14*b*, and a pair of electrodes 13*a* and 13*b*. The electrodes 13*a*, 13*b*, and 14*a*, 14*b* form a second set of electrodes associated with the second gas retaining chamber 3. With this construction, the solid electrolyte member 1 and the pair of electrodes 11*a* and 11*b* together operate as a first oxygen pump unit 15. On the other hand, the solid electrolyte member 1 and the pair of electrodes 12*a* and 12*b* together operate as the first sensor cell unit 16. Similarly, the solid electrolyte member 1 and the pair of electrodes 13*a* and 13*b* together operate as a second oxygen pump unit 17, and the solid electrolyte member and the pair of electrodes 14*a* and 14*b* together operate as the second sensor cell unit 18. Further, heater elements 19 and 20 are respectively provided on an outer wall of the reference gas chamber 6 and an outer wall of the electrode protection cavity 7. The heater elements 19 and 20 are electrically connected in parallel with each other so as to heat the first and second oxygen pump units 15 and 17, and the first and second sensor cell units 16 and 18 equally. The heater elements 19 and 20 further have an effect to enhance the heat retaining property of the solid electrolyte member 1. The solid electrolyte member 1 is made up of a plurality of pieces to form an integral member. In addition, the walls of the first and second gas retaining chambers 2 and 3** need not be made of the oxygen ion conductive solid electrolyte as a whole. At least portions of the wall, on which the electrodes are provided, must be made of the solid electrolyte.

Zirconium dioxide ($ZrO_2$) is suitably used as the oxygen ion conductive solid electrolyte, and platinum (Pt) is used as the electrodes **11*a* through 14*b***.

Figure 5:
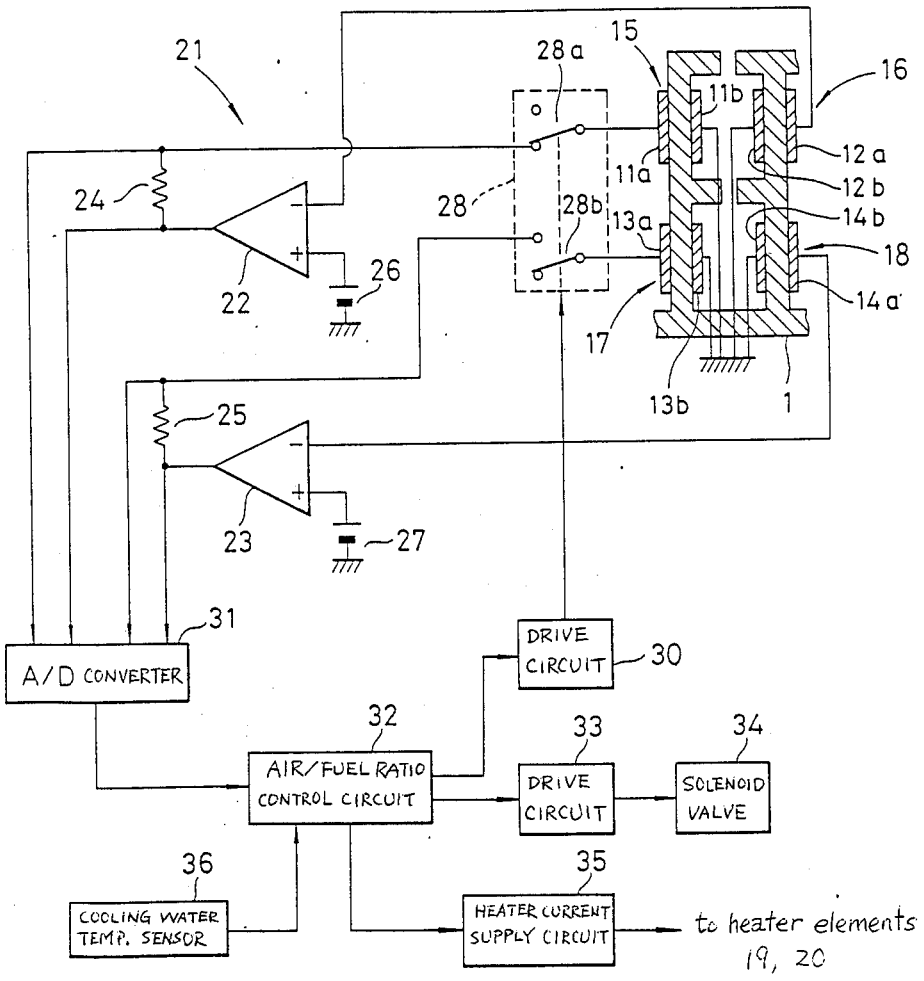
FIG. 5 is a circuit diagram showing a current supply circuit of the oxygen concentration sensor, in which the air/fuel ratio control system is also shown.

The first oxygen pump unit 15 and and the first sensor cell unit 16 form a first sensor, and the second oxygen pump unit 17 and the second sensor cell unit 18 form a second sensor. The first and second oxygen pump units 15 and 17, and the first and second sensor cell units 16 and 18 are connected to a current supply circuit 21. As shown in FIG. 5, the current supply circuit 21 includes differential amplifiers 22 and 23, current detection resistors 24 and 25 for detecting the magnitude of the current, sources 26 and 27 of reference voltages, and a switch circuit 28. The electrode 11*a* provided on the outer surface of the first oxygen pump unit 15 is connected to an output terminal of the differential amplifier 22 through the current detection resistor 24 and a switch element 28*a* of the switch circuit 28. The electrode 11*b* provided on the inner surface of the first oxygen pump unit 15 is grounded. The electrode 12*a* provided on the outer surface of the first sensor cell unit 16 is connected to an inverting input terminal of the differential amplifier 22, and the electrode 12*b* on an inner surface of the first sensor cell unit 16 is grounded. Similarly, the electrode 13*a* provided on the outer surface of the second oxygen pump unit 17 is connected to an output terminal of the differential amplifier 23 through the current detection resistor 25 and a switch element 28*b* of the switch circuit 28. The electrode 13*b* provided on the inner surface of the second oxygen pump unit 17 is grounded. The electrode 14*a* provided on the outer surface of the second sensor cell unit 18 is connected to an inverting input terminal of the differential amplifier 23, and the electrode 14*b* provided on the inner surface of the sensor cell unit 18 is grounded. A non-inverting input terminal of the differential amplifier 22 is connected to the source of the reference voltage 26, and a non-inverting input terminal of the differential amplifier 23 is connected to the source of the reference voltage 27. Output voltages of the sources of the reference voltage 26 and 27 are set to a voltage (0.4 V for example) corresponding to the stoichiometric air/fuel ratio. With the circuit construction described above, the voltage appearing across the terminals of the current detection resistor 24 forms an output signal of the first sensor, and the voltage appearing across the terminals of the current detection resistor 25 forms an output signal of the second sensor. The voltage across the terminals of the current detection resistors 24 and 25 are supplied to the air/fuel ratio control circuit 32 through the A/D converter 31 having a differential input circuit. Thus, pump currents $I_P(1)$ and $I_P(2)$ flowing through the variable resistors 24 and 25 are read by the air/fuel ratio control circuit 32. The air/fuel ratio control circuit 32 comprises a microcomputer. An output signal of a cooling water temperature sensor 36 for sensing an engine cooling water temperature is connected to the air/fuel ratio control circuit 32. This air/fuel ratio control circuit 32 is further supplied with output signals of a plurality of sensors (not shown) for sensing operational parameters of the engine, such as an engine rotational speed, and an absolute pressure in the intake pipe. Further, the solenoid valve 34 is connected to the air/fuel ratio control circuit 32 via the drive circuit 33. The solenoid valve 34 is provided in an air intake side secondary air supply passage (also not shown) leading to an intake manifold at a position downstream of a throttle valve of a carburetor of the engine. The air/fuel ratio control circuit 32 further controls the switching operation of the switch circuit 28, in such a manner that the drive circuit 30 drives the switch circuit 28 in accordance with a command from the air/fuel ratio control circuit 32. In addition, the differential circuits 22 and 23 are supplied with positive and negative power voltages.

On the other hand, the heater elements 19 and 20 are connected to a heater current supply circuit 35 that supplies currents to the heater elements 19 and 20 in response to a heater current supply start command from the air/fuel ratio control circuit 32. By operating the heater elements 18 and 19 in this way, the oxygen pump units 15 and 17, and the sensor cell units 16 and 18 are heated to a suitable temperature level which is higher than the temperature of the exhaust gas.

Thus, with the constructed oxygen concentration sensor, the exhaust gas in an exhaust manifold flows into the first gas retaining chamber 2 through the gas introduction port 4 and is diffused therein. Also, the exhaust gas that enters into the first gas retaining chamber 2 is introduced into the second gas retaining chamber 3 through the communication channel 5 and is diffused therein.

If the switch element 28*a* is positioned to connect the terminal 11*a* to the current detection resistor 24 and the switch element 28*a* is positioned to open the line connecting the electrode 13*a* and the current detection resistor 25 as shown in FIG. 5, then the switch circuit 28 is in the position for selecting the first sensor.

Under this condition for selecting the first sensor, the output signal level of the differential amplifier 22 is in a positive level when the air/fuel ratio of the mixture is in a lean range. This positive level output voltage is supplied to the series circuit of the first oxygen pump unit 15. Therefore, a pump current flows through the electrodes 11*a* and 11*b* of the first oxygen pump unit 15. Since this pump current flows from the electrode 11*a* to the electrode 11*b*, oxygen in the first gas retaining chamber 2 is ionized at the electrode 11*b* and moves through the oxygen pump unit 15 to the electrode 11*a*. At the electrode 11*a*, the oxygen is released in the form of oxygen gas. In this way, oxygen in the first gas retaining chamber 2 is pumped out.

By the pumping out of oxygen in the first gas retaining chamber 2, a difference in the oxygen concentration develops between the exhaust gas in the first gas retaining chamber 2 and a gas in the reference gas chamber 6. By this difference in the oxygen concentration, a voltage $V_s$ is generated across the electrodes 12*a* and 12*b* of the sensor cell unit 16, and in turn is supplied to the inverting input terminal of the differential amplifier 22. Therefore, the voltage of the output signal of the differential amplifier 22 becomes proportional to the differential voltage between the voltage $V_s$ and a voltage $Vr_1$ of the output signal of the source of the reference voltage 26. Thus, the magnitude of the pump current becomes proportional to the oxygen concentration in the exhaust gas.

Figure 6:
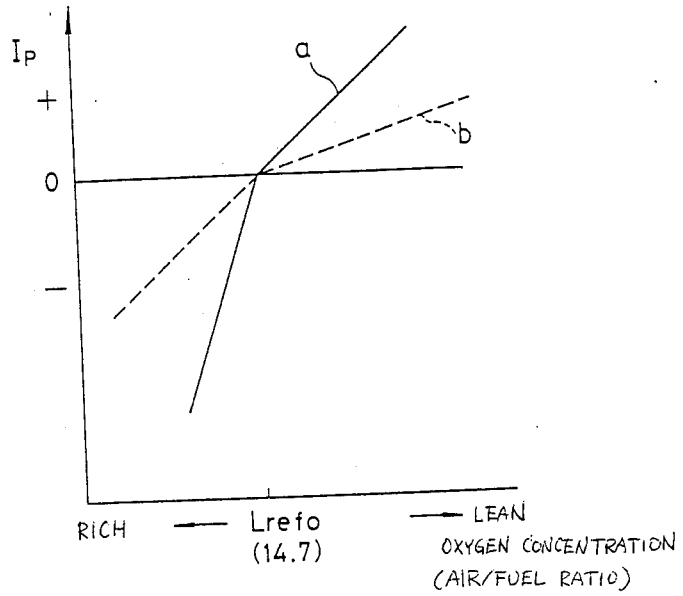
FIG. 6 is a diagram showing an output signal characteristic of the oxygen concentration sensor.

When the air/fuel ratio of the mixture is in a rich range, the voltage $V_s$ exceeds the output voltage $Vr_1$ of the source of the reference voltage 26. Therefore, the output signal level of the differential amplifier 22 turns from the positive level to the negative level. By this negative level, the pump current flowing across the electrodes 11*a* and 11*b* of the first oxygem pump unit 15 is reduced, and the direction of the flow of the current will be turned over. More specifically, the pump current will flow from the electrode 11*b* to the electrode 11*a*, so that the oxygen in the outside is ionized at the electrode 11*a* and in turn moves through the first oxygen pump unit 15 to the electrode 11*b*. At the electrode 11*b*, the oxygen is released in the form of oxygen gas into the first gas retaining chamber 2. In this way, the oxygen is pumped into the first gas retaining chamber 2. In summary, the operation of the apparatus is such that the pump current is supplied so that the oxygen concentration in the first gas retaining chamber 2 is maintained constant, and the oxygen is pumped in or out according to the direction of the pump current. Therefore, the magnitude of the pump current and the output signal voltage of the differential amplifier 22 become proportional to the oxygen concentration in the exhaust gas in both of the lean and rich ranges. In FIG. 6, the solid line shows the magnitude of the pump current $I_p$.

On the other hand, the pump current $I_P$ is expressed by the following equation:

$$I_P = 4e\,\sigma o\,(\text{Poexh} - \text{Pov}) \quad (1)$$

in which e represents the electric charge, $\sigma o$ represents the diffusion coefficient of the gas introduction port 4 against the exhaust gas, Poexh represents the oxygen concentration of the exhaust gas, and Pov represents the oxygen concentration in the first gas retaining chamber 2.

The diffusion coefficient $\sigma o$ can be expressed by the following equation:

$$\sigma = oD \cdot A/kTl \quad (2)$$

where A represents the sectional area of the gas introduction port 4, k represents Boltzmann's constant, T represents absolute temperature, l represents the length of the gas introduction port 4, and D represents a diffusion constant.

On the other hand, the second sensor is selected when the switch element **28*a* is positioned to open the line connecting the electrode 11*a* and the current detection resistor 24, and the switch element 28*b* is positioned to connect the electrode 13*a* to the current detection resistor 25**.

In this state of selecting the second sensor, the pump current is supplied across the electrodes **13*a* and 13*b* of the second oxygen pump unit 17 so that the oxygen concentration in the second gas retaining chamber 3 is maintained constant by the same operation as that in the state where the first sensor is selected. Thus, the oxygen is pumped in or out by the pump current, and the magnitude of the pump current and the output signal of the differential amplifier 23** vary in proportion to the oxygen concentration both in the lean range and in the rich range.

In the state in which the second sensor is selected, the magnitude of the pump current can be expressed by using the equation (1) with the diffusion coefficient $\sigma o$ calculated for the gas introduction port 4 and the communication channel 5 also, and the oxygen concentration in the second gas retaining chamber 3 as the value Pov.

On the other hand, it is known that the magnitude of the pump current becomes small as the increase in a diffusion resistance which is inversely proportional to the diffusion coefficient $\sigma o$, both in the lean range and the rich range of the air/fuel ratio. This means that, when the second sensor is selected, the diffusion resistance becomes larger than that in the state where the first sensor is selected. Therefore, as shown by the dashed line b in FIG. 6, the magnitude of the pump current is smaller than it is in the state where the first sensor is selected, in both the lean and rich ranges.

Further, by selecting suitable size and length of the communication channel 5, the characteristic curve of the pump current with the second sensor in the rich range connects directly to the characteristic curve of the pump current with the first sensor in the lean range at a point where $I_P$ is zero ($I_P=0$). Thus, a characteristic curve of the pump current forming a straight line passing through the lean range and the rich range can be obtained by combining the first and second sensors. Also, with suitable control operation characteristic curves of the output signals of the first and second differential amplifiers 22 and 23 can be connected directly to each other at a point where the voltage level is equal to zero.

Figure 7:
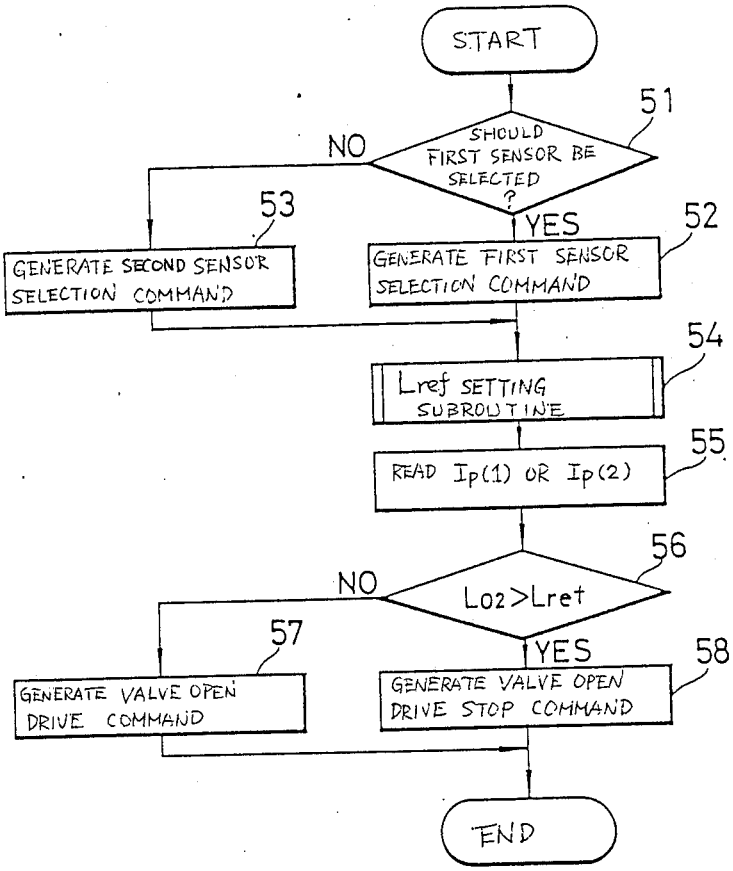
FIGS. 7 and 8 are flowcharts showing steps of the control method according to the present invention which are performed by the air/fuel ratio control circuit shown in FIG. 5.

The details of the control method according to the present invention will be explained with reference to the flowchart of FIG. 7 showing the operation of the air/fuel ratio control circuit 32 as follows.

The air/fuel ratio control circuit 32 detects which of the first and second sensors should be selected at a step 51. This determination is performed in response to the engine operation or the controlled state of the air/fuel ratio. If it is determined that the first sensor should be selected, then the control circuit 32 supplies a first sensor selection command to the drive circuit 30 at a step 52. Conversely, if it is determined that the second sensor sould be selected, then the control circuit 32 supplies a second sensor selection command to the drive circuit 30 at a step 53. In response to the first sensor selection command, the control circuit 30 drives the switches **28*a* and 28*b* towards the aforementioned positions for selecting the first sensor. These switch positions are maintained until the second sensor selection command or a selection cancel command is supplied from the control circuit 32. When the first sensor is selected in this way, the pump current is supplied to the first oxygen pump unit 15. Similarly, in response to the second sensor selection command, the control circuit 32 drives the switches 28*a* and 28*b* towards the aforementioned positions for selecting the second sensor. These switch positions for selecting the second sensor are maintained until the first sensor selection command or the selection cancel command is supplied from the control circuit 32. When the second sensor is selected in this way, the pump current is supplied to the second pump element 16**.

Then, a Lref setting subroutine for setting the target value Lref representing the target air/fuel ratio is executed by the control circuit 32 at a step 54. Further, the control circuit 32 reads in a pump current value $I_P(1)$ or a pump current value $I_P(2)$ from the A/D converter 31 at a step 55. Then the control circuit 32 detects as to whether or not an oxygen concentration detection output signal value $LO_2$, corresponding to the pump current value $I_P$ (1) or the pump current value $I_P$ (2), is higher than the target value Lref, at a step 56. If $LO_2 \leqq$ Lref, it means that the air/fuel ratio of the mixture supplied to the engine is rich. Therefore, the control circuit 32 generates a valve open drive command for opening the solenoid valve 34, and supplies it to the drive circuit 33, at a step 57. If $LO_2 >$ Lref, it means that the air/fuel ratio of the mixture is lean. A valve open drive stop command for closing the solenoid valve 34 is generated by the control circuit 32 and in turn supplied to the drive circuit 33 at a step 58. In accordance with the valve open drive command, the drive circuit 33 opens the solenoid valve 34 to introduce the secondary air into the intake manifold of the engine, so that the air/fuel ratio of the mixture is made lean. Conversely, in response to the valve open drive stop command, the drive circuit 33 closes the solenoid valve 34, so that the air/fuel ratio of mixture is enriched. By executing these operations repeatedly at predetermined intervals, the air/fuel ratio of the mixture supplied to the engine is controlled to the target air/fuel ratio.

Figure 8:
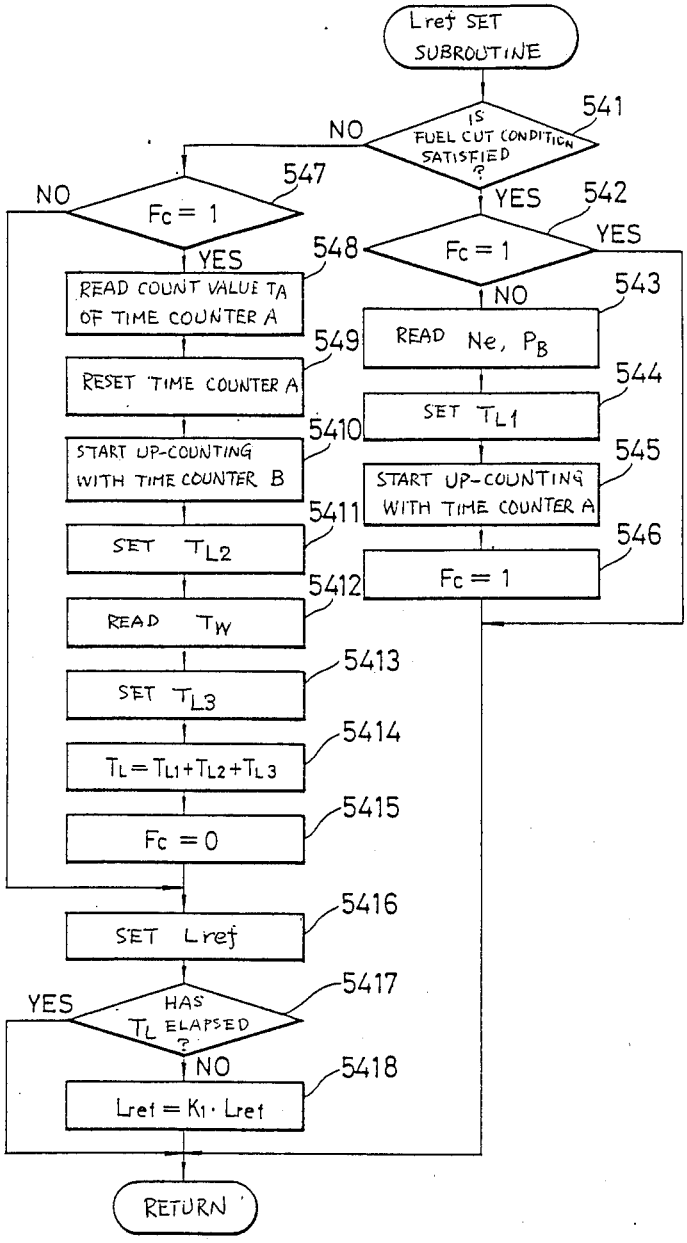
Figure 9:
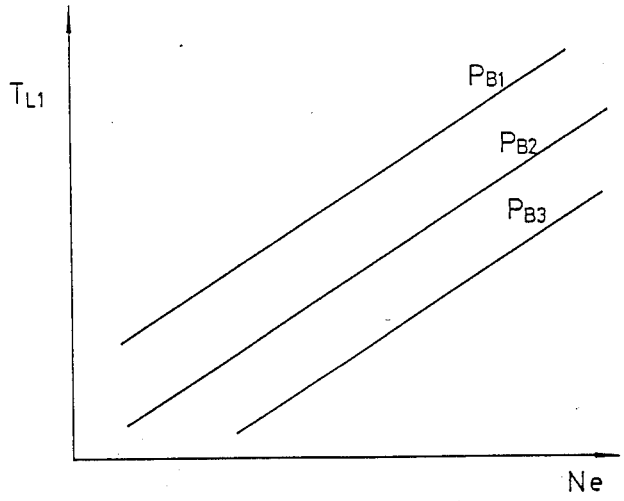

In the Lref set subroutine, as shown in FIG. 8, the control circuit 32 detects, at a step 541, as to whether or not a condition for the fuel cut operation is satisfied. The condition for the fuel cut operation is such that the throttle valve is fully closed and the engine speed is in a predetermined high speed range. The condition for the fuel cut operation is satisfied, whether or not a fuel cut flag Fc equal to "1" is then detected at a step 542. IF Fc=0, it means that the fuel cut operation is just started, and the control circuit 32 reads in the engine speed Ne and the pressure $P_B$ in the intake manifold at a step 543. Further, the control circuit 32 sets a first delay time period $T_{L1}$ in accordance with the read values of the engine speed Ne and the pressure $P_B$ in the intake manifold, at a step 544. Various values for the first delay time period $T_{L1}$ each corresponding to values of the engine speed Ne and the pressure $P_B$ in the intake manifold are previously stored in a memory, such as a ROM, in the control circuit 32 in the form of a data map. The relation between the first delay time period $T_{L1}$ and the engine speed Ne for different pressure values $P_{B1}$, $P_{B2}$, $P_{B3}$ is as shown in FIG. 9. The setting of the first delay time period $T_{L1}$ is performed, at control circuit 32, by searching a value of the first delay time period $T_{L1}$ from the data map, and using the read value of the engine speed Ne and the pressure $P_B$ in the intake manifold. The first delay time period $T_{L1}$ is determined according to the engine speed Ne and the pressure $P_B$ in the intake manifold in such a manner that it is prolonged as the amount of the intake air increases, because the amount of the fuel sucked into the engine, which was adhered to the inner walls of the intake manifold, increases as the amount of the intake air before and after the fuel cut increases. Further, the engine speed Ne and the pressure $P_B$ in the intake manifold to be used for determining the first delay time period $T_{L1}$ are not limited to its values detected immediately after the start of the fuel cut operation. For example, an engine speed value Ne and a pressure value $P_B$ in the intake manifold detected during the fuel cut operation or immediately after the completion of the fuel cut operation can be used for setting the first delay time period $T_{L1}$. After the setting of the first delay time period $T_{L1}$, up-counting of a time counter A (not shown) in the air/fuel ratio control circuit 32 is started from a standard value at a step 545. A value "1" is set for the fuel cut flag Fc, to memorize the starting of the fuel cut operation at a step 546. On the other hand, if the flag Fc is detected to be equal to "1" (Fc=1) at the step 542, it is regarded that the fuel cut operation is continuously taking place.

Figure 10:
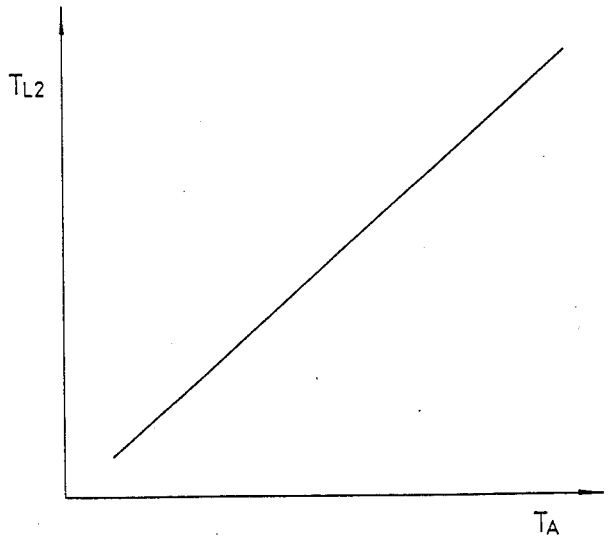

If it is detected at the step 541, that the condition of the fuel cut operation is not satisfied, whether or not the fuel cut flag Fc is equal to "1" detected at a step 547. If Fc=1, it is regarded that the fuel cut operation is finished, and the control circuit 32 reads a count value $T_A$ of the time counter A at a step 548. Then, the time counter A is reset to the standard value at a step 549. At the same time up-counting of a time counter B (not shown) in the air/fuel ratio control circuit 32 is started from a standard value, at a step 5410. Then, a second delay time $T_{L2}$ is set at a step 5411 in accordance with the count value $T_A$, i.e., the time period of the fuel cut operation. Further, the cooling water temperature value $T_W$ is read from an output of the cooling water temperature sensor 36 at a step 5412, and a third delay time period $T_{L3}$ is set in accordance with the read value of the cooling water temperature $T_W$, at a step 5413. In the aforementioned memory of the air/fuel ratio control circuit 32, various values for the second delay time $T_{L2}$ are stored in such a manner as illustrated in FIG. 10, as a $T_{L2}$ data map. The second delay time $T_{L2}$ is determined to become long as the duration of the fuel cut operation is prolonged, because the amount of the fuel sucked into the engine which was adhered to the inner walls of the intake manifold increases as the period of the fuel cut operation increases. Further, various values for the third delay time period $T_{L3}$ corresponding to the cooling water temperature $T_W$ are previously stored as a $T_{L3}$ data map in such a manner as illustrated in FIG. 11 in the aforementioned memory of the air/fuel ratio control circuit 32. The third delay time $T_{L3}$ is determined to become large as the temperature of the engine decreases. This is because the amount of the fuel sucked into the engine, which was adhered to the inner walls of the intake manifold, increases with the decrease of the temperature of the engine. Therefore, the control circuit 32 searches a value of the second delay time period corresponding to the read value of the count value $T_A$ from the $T_{L2}$ data map, and a value of the third delay time period $T_{L3}$ corresponding to the read value of the cooling water temperature $T_W$ from the $T_{L3}$ data map respectively. The delay times $T_{L1}$, $T_{L2}$, and $T_{L3}$ are provided since the detection of the air/fuel ratio will be inaccurate during the period of these delay times due to the adhesion of the fuel to the inner walls of the intake manifold at the time of resumption of the fuel supply. After setting the delay time periods $T_{L1}$, $T_{L2}$, and $T_{L3}$ in this way, the delay time periods $T_{L1}$, $T_{L2}$, and $T_{L3}$ are added together at a step 5414, and the calculated value is in turn used as the delay time $T_L$. Further, in order to memorize that the fuel cut operation is not taking place, a value "0" is set for the fuel cut flag Fc at a step 5415. Subsequently, the target value Lref is set in accordance with operational parameters such as the engine speed Ne and the pressure $P_B$ in the intake manifold at a step 5416. Then, at a step 5417, whether or not a time that is period more than the delay time period $T_L$ has elapsed is detected by using a count value $T_B$ of the time counter B at a step 5417. If $T_B<T_L$, it means that the delay time period $T_L$ has not elapsed after the stop of the fuel cut operation. Therefore, the target value Lref set at the step 5416 is multiplied with a coefficient $K_1$ ($K_1>1$), and a calculated value is set as a new target value Lref at a step 5418. If $T_B \geqq T_L$, it means that a time period equal to or more than the delay time period $T_L$ has elapsed after the stop of the fuel cut opeation. In this state, the target value Lref set at the step 5416 is maintained.

In addition, the count operation of the time counters A and B are executed in a calculation subroutine which is different from the subroutine described so far.

In short, in the control method according to the present invention, during the delay time period $T_L$ after the completion of the fuel cut operation, the target value of the air/fuel ratio is controlled to be greater than the target value used after the elapse of the delay time period $T_L$. Therefore, as shown in FIG. 12A, the detection output signal level of the oxygen concentration sensor becomes slightly higher than a level $V_1$ before the start time $t_1$ of the fuel cut operation, instead of reaching to the level $V_1$ immediately. At the time $t_3$, i.e. upon the elapse of the delay time $T_L$ from the time point $t_2$, the output signal level of the oxygen concentration sensor reaches to the level $V_1$. In this way, as shown in FIG. 12B, the method of the present invention is operative to prevent a large deviation of the air/fuel ratio of the mixture to be supplied to the engine in the rich direction at the time point $t_2$ immediately after the completion of the fuel cut operation. In short, the air/fuel ratio of the mixture is maintained substantially at a level before the time point $t_1$ of the start of the fuel cut operation.

In the embodiment of the present invention explained so far, the delay time period is determined according to various operational parameters detected during the fuel cut operation. However, the arrangement is not limited to this, and a fixed time period can be always used for the delay time period.

It will be appreciated from the foregoing, in the control method according to the present invention, within the delay time period after the time point of the detection of transition from the fuel cut operation to the resumption of the fuel supply, the target value of the air/fuel ratio is determined to be larger than its value to be used after the elapse of the delay time period. Therefore, a large deviation of the air/fuel ratio of the mixture in the rich direction, which may otherwise occur, is prevented. Thus, the accuracy of the air/fuel ratio control is improved, and at the same time, emission of the unburnt component such as CO, HC immediately after the completion of the fuel cut operation, is effectively reduced.

What is claimed is:

1. A method for controlling an air/fuel ratio of an internal combustion engine having an air/fuel ratio control system for controlling a mixture to be supplied to said engine, comprising:

normally operating said air/fuel ratio control system by controlling an air/fuel ratio of said mixture by a feedback control operation toward a target air/fuel ratio in accordance with an oxygen concentration in an exhaust gas of said engine;

placing said air/fuel ratio control system in a fuel cut mode when a condition for a fuel cut operation is satisfied; and resuming operation of said air/fuel ratio control system by performing said feedback control operation while controlling said target air/fuel ratio, for a predetermined time period after said fuel cut operation is terminated and said fuel supply is resumed, to be larger than a target air/fuel ratio value to be used after an elapse of said predetermined time period.

2. A method for controlling an air/fuel ratio of an internal combustion engine having an air/fuel ratio control system for controlling a mixture to be supplied to said engine, comprising:

normally operating said air/fuel ratio control system by controlling an air/fuel ratio of said mixture by a feedback control operation toward a target air/fuel ratio in accordance with an oxygen concentration in an exhaust gas of said engine;

placing said air/fuel ratio control system in a fuel cut mode when a condition for a fuel cut operation is satisfied;

detecting at least one parameter of engine operation when said air/fuel ratio control system is in the fuel cut mode;

calculating a delay time period based on said parameter of engine operation; and resuming operation of said air/fuel ratio control system by performing said feedback control operation while controlling said target air/fuel ratio, for said delay time period after said fuel cut mode is terminated and fuel supply is resumed, to be larger than a target air/fuel ratio value to be used after an elapse of said predetermined time period.

3. The method of claim 1 wherein said fuel cut mode substantially stops the fuel supplied said engine.

4. The method of claim 2 wherein said fuel cut mode substantially stops the fuel supplied said engine.

5. The method of claim 1 wherein said step of resuming operation by controlling said target air/fuel ratio is performed by multiplying said target air/fuel ratio by a constant K of greater than 1.

6. The method of claim 2 wherein said step of resuming operation by controlling said target air/fuel ratio is performed by multiplying said target air/fuel ratio by a constant K of greater than 1.

7. In an air/fuel ratio control system, employing an oxygen sensor, for controlling the mixture of an air/fuel ratio supplied to an internal combustion engine, said air/fuel ratio control system normally operating in a feedback mode wherein said air/fuel ratio is controlled toward a target air fuel ratio and operating in a fuel cut mode when predetermined conditions are satisfied, a method for controlling the air/fuel ratio after termination of a fuel cut mode of said control system comprising:

detecting completion of said fuel cut mode and resumption of the fuel supply to said engine; and increasing said target air/fuel ratio for a predetermined period of time after detection of the completion of said fuel cut mode by said step of detecting to correct a temporary rich mixture condition occuring after operation of said control system in said fuel cut mode.

8. The method of claim 7 wherein said fuel cut mode substantially stops the fuel supplied said engine.

9. The method of claim 7 wherein said step of increasing said target air/fuel ratio for a predetermined time is performed by multiplying said target air/fuel ratio by a constant K greater than 1.

10. The method of claim 7 further comprising:

detecting at least one parameter of engine operation when said engine is in said fuel cut mode; and calculating said predetermined period based on said parameter of engine operation.

* * * * *